US009020738B2

(12) United States Patent
Kaneko

(10) Patent No.: US 9,020,738 B2
(45) Date of Patent: Apr. 28, 2015

(54) FUEL INJECTION CONTROL DEVICE FOR INTERNAL COMBUSTION

(75) Inventor: Naoya Kaneko, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 51 days.

(21) Appl. No.: 14/002,607

(22) PCT Filed: Mar. 30, 2011

(86) PCT No.: PCT/JP2011/058044

§ 371 (c)(1), (2), (4) Date: Aug. 30, 2013

(87) PCT Pub. No.: WO2012/131943

PCT Pub. Date: Oct. 4, 2012

(65) Prior Publication Data

US 2014/0007843 A1 Jan. 9, 2014

(51) Int. Cl.

| | |
|---|---|
| ***F02M 43/00*** | (2006.01) |
| ***F02B 5/00*** | (2006.01) |
| ***F02D 19/08*** | (2006.01) |
| ***F02M 69/04*** | (2006.01) |
| ***F02D 41/30*** | (2006.01) |
| *F02D 41/32* | (2006.01) |
| *F02D 41/00* | (2006.01) |
| *F02D 41/18* | (2006.01) |

(52) U.S. Cl.

CPC ..... *F02M 69/04* (2013.01); *F02D 19/08* (2013.01); *F02D 41/3094* (2013.01); *F02D 41/32* (2013.01); *F02M 69/042* (2013.01); *F02D 41/0065* (2013.01); *F02D 41/18* (2013.01)

(58) Field of Classification Search

CPC .... F02D 19/08; F02D 41/0025; F02M 43/00; F02B 5/00; F02B 1/12; F02B 3/06

USPC ..... 123/431, 304, 305; 701/102–104

See application file for complete search history.

(56) References Cited

U.S. PATENT DOCUMENTS

| | | | | |
|---|---|---|---|---|
| 7,104,255 | B2 * | 9/2006 | Hashima et al. | 123/431 |
| 7,159,568 | B1 * | 1/2007 | Lewis et al. | 123/431 |
| 7,377,255 | B2 * | 5/2008 | Miyashita | 123/305 |
| 7,406,947 | B2 * | 8/2008 | Lewis et al. | 123/478 |

(Continued)

FOREIGN PATENT DOCUMENTS

| | | |
|---|---|---|
| JP | 2001-214785 A | 8/2001 |
| JP | 2005-201083 A | 7/2005 |

(Continued)

*Primary Examiner* — Thomas Moulis

(74) *Attorney, Agent, or Firm* — Sughrue Mion, PLLC

(57) ABSTRACT

The purpose of the present invention is to suppress, in an internal combustion engine in which two injectors are disposed in a line upstream and downstream in an intake pipe, adhesion of deposits to the downstream-side injector. In order to suppress such adhesion, a fuel injection control device according to one embodiment of the present invention operates both injectors together when a required fuel injection amount is equal to or greater than a reference value. The reference value is set to a value equal to or greater than the sum of lower limit injection amounts of the injectors. In such case, the fuel injection control device adjusts the proportion of fuel injected from the injector disposed downstream in the intake pipe to be greater than the proportion of fuel injected from the injector disposed upstream in the intake pipe.

7 Claims, 4 Drawing Sheets

(56) References Cited

U.S. PATENT DOCUMENTS

| | | | | |
|---|---|---|---|---|
| 7,779,813 | B2 * | 8/2010 | Hahn | 123/406.47 |
| 2005/0120786 | A1 * | 6/2005 | Tsujimura et al. | 73/119 R |
| 2005/0166896 | A1 | 8/2005 | Sadakane et al. | |
| 2005/0172931 | A1 * | 8/2005 | Mori | 123/305 |
| 2006/0016431 | A1 * | 1/2006 | Mashiki et al. | 123/431 |
| 2006/0021422 | A1 * | 2/2006 | Demura et al. | 73/35.01 |
| 2006/0021594 | A1 * | 2/2006 | Maruyama | 123/299 |
| 2006/0021595 | A1 * | 2/2006 | Miyashita | 123/299 |
| 2006/0037582 | A1 * | 2/2006 | Adachi et al. | 123/305 |
| 2006/0207560 | A1 * | 9/2006 | Kobayashi | 123/431 |
| 2006/0207566 | A1 * | 9/2006 | Kobayashi | 123/431 |
| 2008/0127933 | A1 * | 6/2008 | Blumberg et al. | 123/304 |
| 2008/0288158 | A1 * | 11/2008 | Leone | 701/103 |
| 2010/0161203 | A1 * | 6/2010 | Shigenaga et al. | 701/110 |

FOREIGN PATENT DOCUMENTS

| | | | |
|---|---|---|---|
| JP | 2005-226529 | A | 8/2005 |
| JP | 2008-163749 | A | 7/2008 |
| JP | 2008-298046 | A | 12/2008 |
| JP | 2010-065623 | A | 3/2010 |

* cited by examiner

FUEL INJECTION CONTROL DEVICE FOR INTERNAL COMBUSTION

CROSS REFERENCE TO RELATED APPLICATIONS

This application is a National Stage of International Application No. PCT/JP2011/058044 filed Mar. 30, 2011, the contents of all of which are incorporated herein by reference in their entirety.

TECHNICAL FIELD

The present invention relates to a fuel injection control device for an internal combustion engine, and more particularly to a fuel injection control device for an internal combustion engine that includes a first injector that is disposed at an upstream position in an intake pipe and a second injector that is disposed at a downstream position in the intake pipe.

BACKGROUND ART

An internal combustion engine in which two injectors are disposed in an aligned relationship at an upstream position and a downstream position in an intake pipe and which is configured to actuate both injectors to perform fuel injection is known. However, even in the aforementioned internal combustion engine, if a requested injection quantity is less than a sum of the lower limit injection quantities of the respective injectors, it is necessarily only possible to actuate either one of the injectors. In that case, at the injector that is stopped, deposits adhere to the tip of the injector during the stopped period as the result of the tip being exposed to a high temperature due to radiant heat or gas that is blown back from inside the cylinder. In contrast, at the injector that is operating, since the tip thereof is cooled by fuel that is injected, the adherence of deposits under a high temperature environment is suppressed in comparison to the injector that is stopped.

For this reason, a control device disclosed in Japanese Patent Laid-Open No. 2008-163749 Publication is configured to alternatively switch the injector to be stopped between two injectors in a case where a requested injection quantity is less than a predetermined value. The switching timing is determined in accordance with whether or not an injection stop period of the injector at which injection was stopped or the number of stopped injection cycles has reached a predetermined limit value. According to this configuration, since an operating period and a stopping period are alternatively repeated at each injector, a situation does not arise in which only a specific injector is exposed to a high temperature for an extended period in a state in which fuel injection has been stopped, and thus adherence of deposits to the tips of the injectors is suppressed.

However, adherence of deposits to an injector can also occur in a situation in which fuel is being injected. In particular, since an injector on a downstream side is located in a thermally severe environment in comparison to an injector on the upstream side, adherence of deposits thereto is liable to occur. Hence it is desirable to also implement some kind of countermeasure in a situation in which both injectors can be actuated, and not just in a situation in which it is possible to actuate only one of the two injectors. In the case of the control device disclosed in the above described publication, when a requested injection quantity is equal to or greater than a predetermined value, half of the requested injection quantity is injected by the injector on the upstream side and the remaining half of the requested injection quantity is injected by the injector on the downstream side. Making the proportions of fuel that are injected by the two injectors the same in this manner is one example of injection proportions that can be easily conceived of by a person skilled in the art. However, when the problem regarding adherence of deposits to the injector on the downstream side is taken into account, it can not be said that simply setting the injection proportions to a ratio of 1:1 is necessarily the most suitable example.

CITATION LIST

Patent Literature

Patent Literature 1: Japanese Patent Laid-Open No. 2008-163749 Publication

Patent Literature 2: Japanese Patent Laid-Open No. 2005-226529 Publication

SUMMARY OF INVENTION

An object of the present invention is to enable suppression of adherence of deposits to an injector on a downstream side in an internal combustion engine in which two injectors are disposed in an aligned relationship at an upstream position and a downstream position in an intake pipe. To achieve the aforementioned object, the present invention provides a fuel injection control device for an internal combustion engine that is described below.

A fuel injection control device as one form of the present invention actuates two injectors together in a case where a requested fuel injection quantity is equal to or greater than a reference value. The reference value is set to a value that is equal to or greater than a sum of lower limit injection quantities of the respective injectors. At such time, the present fuel injection control device makes a proportion of fuel that is injected from an injector disposed at a downstream position in an intake pipe larger than a proportion of fuel that is injected from an injector disposed at an upstream position in the intake pipe. By deciding the injection proportion of each injector in this manner, a cooling effect produced by fuel at the downstream-side injector that is at a thermally severe position can be increased. In addition, by also injecting fuel from the upstream-side injector, the upstream-side injector itself is cooled by fuel, and at the same time, the downstream-side injector can be further cooled by latent heat of vaporization when the injected fuel of the upstream-side injector vaporizes. Note that when the requested fuel injection quantity is less than the reference value, it is preferable to actuate only the downstream-side injector that is disposed under a thermally severe condition to thereby promote cooling by fuel.

According to a more preferable form of the present invention, when actuating the two injectors together, the present fuel injection control device increases a proportion of fuel that is injected by the injector on the upstream side as an intake air quantity increases. That is, as the intake air quantity increases, the ratio between the proportion of fuel injected by the upstream-side injector and the proportion of fuel injected by the downstream-side injector approaches a 1:1 ratio. As the intake air quantity increases, an effect by the air carrying away heat increases. In addition, a cooling effect that is produced by fuel also increases as the fuel injection quantity increases. Therefore, as the intake air quantity increases, the proportion of fuel that is injected by the downstream-side injector can be reduced while still suppressing the adherence of deposits. Further, in the case of fuel injection by the upstream-side injector, since a certain time period exists from when the fuel is injected until the fuel enters the cylinder, it is easier for atomization of fuel to proceed in comparison to fuel injection by the downstream-side injector. Hence, by increasing the proportion of fuel that is injected by the upstream-side injector, atomization of fuel can be promoted to thereby improve the homogeneity of the air-fuel mixture.

According to another preferable form of the present invention, when actuating the two injectors together, the present fuel injection control device causes the two injectors to perform fuel injection by synchronous injection. According to the synchronous injection, air that is taken into the cylinder is cooled by latent heat of vaporization when fuel vaporizes, and thus the in-cylinder temperature can be lowered. If the in-cylinder temperature falls, not only can knocking be reduced, but an improvement in fuel consumption and an improvement in transient torque characteristics can also be achieved as the result of an improvement in the air charging efficiency. Further, since fuel injected from the upstream-side injector rides on the intake air flow and vaporizes in the vicinity of the downstream-side injector, it is possible for a significant cooling effect on the downstream-side injector to be obtained by means of latent heat of vaporization.

When performing fuel injection by synchronous injection at two injectors in this manner, it is preferable to make the proportion of fuel injected by the downstream-side injector smaller in comparison to a case of injecting fuel of identical quantities by asynchronous injection. This is because, according to synchronous injection, the fuel quantity that is injected from the downstream-side injector can be reduced by an amount that corresponds to the increase in the cooling effect on the downstream-side injector that is obtained by means of latent heat of vaporization. By increasing the proportion of fuel injected by the upstream-side injector by the aforementioned amount, atomization of the fuel can be promoted further and the homogeneity of the air-fuel mixture can be further improved.

In addition, when performing fuel injection by synchronous injection at both injectors, more preferably, with respect to the downstream-side injector, some fuel is injected by asynchronous injection prior to the synchronous injection. That is, with respect to the upstream-side injector, all of the fuel is injected by synchronous injection, and with respect to the downstream-side injector, injection of the fuel is divided between asynchronous injection and synchronous injection. In a state in which an intake valve is closed, since EGR gas that serves as a base for formation of deposits stays in the vicinity of the tip of the downstream-side injector for an extended period, deposits are liable to be formed on the tip of the downstream-side injector by means of radiant heat from the combustion chamber. However, by dividing the fuel injection over two operations and injecting some of the fuel by asynchronous injection in this manner, initial deposits can be blown off from the tip of the downstream-side injector.

Note that a fuel injection quantity that is injected by each injector can be controlled by means of the fuel injection time periods as long as there is no significant difference in the specifications of the two injectors. However, if the flow rates of the two injectors are made different to each other, specifically, if the flow rate of the downstream-side injector is made greater than the flow rate of the upstream-side injector, it is possible to make the fuel injection periods at the two injectors approximately identical to unify the control. Further, a fuel pressure of the downstream-side injector may be made larger than a fuel pressure of the upstream-side injector. Thus, a fuel injection quantity per unit time that is injected by the downstream-side injector can be increased, and atomization of fuel that is injected by the downstream-side injector is also enabled.

DESCRIPTION OF EMBODIMENTS

Embodiment 1

Embodiment 1 of the present invention will now be described with reference to the drawings.

An internal combustion engine to which a fuel injection control device of the present embodiment is applied is an internal combustion engine for an automobile. More specifically, the internal combustion engine is a premixed combustion-type four-stroke, one-cycle reciprocating engine. The fuel injection control device of the present embodiment is implemented as one function of an ECU that controls the overall operations of the internal combustion engine.

Figure 1:
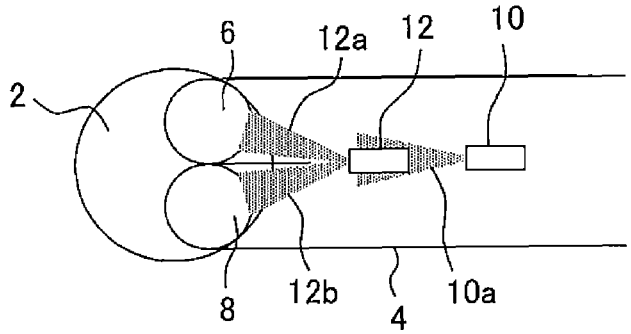
FIG. 1 is a view that illustrates a configuration in an area around an intake port of an internal combustion engine to which a fuel injection control device of embodiment 1 of the present invention is applied.

FIG. 1 is a view that illustrates a configuration in an area around an intake port of the internal combustion engine to which the present fuel injection control device is applied. In the internal combustion engine to which the present fuel injection control device is applied, a distal end of an intake pipe 4 branches into two intake ports 6 and 8, and the respective intake ports 6 and 8 are connected to a combustion chamber 2. On the upstream side of the portion that branches into the intake ports 6 and 8 in the intake pipe 4, two injectors 10 and 12 are disposed in an aligned relationship in the flow direction of the intake pipe 4. There is a difference in structure between the first injector 10 that is on the upstream side and the second injector 12 that is on the downstream side. The first injector 10 is an injector that can inject over a wide angle in one direction, and a single fuel spray 10*a* that spreads over a wide angle is formed by fuel injection thereof. The second injector 12 injects fuel in two directions, and two fuel sprays 12*a* and 12*b* towards the respective intake ports are formed by fuel injection thereof.

Among the two injectors 10 and 12, the second injector 12 that is on the downstream side near to the combustion chamber 2 is the injector that is under a thermally severe environment. The tip of the second injector 12 is exposed to a high temperature by radiant heat and gas that is blown back from the combustion chamber 2. Consequently, in comparison to the first injector 10 on the upstream side, deposits are liable to adhere to the second injector 12. Therefore, the present fuel injection control device controls the actions of the two injectors 10 and 12 in the manner described below to suppress the adherence of deposits to the second injector 12.

Figure 2:
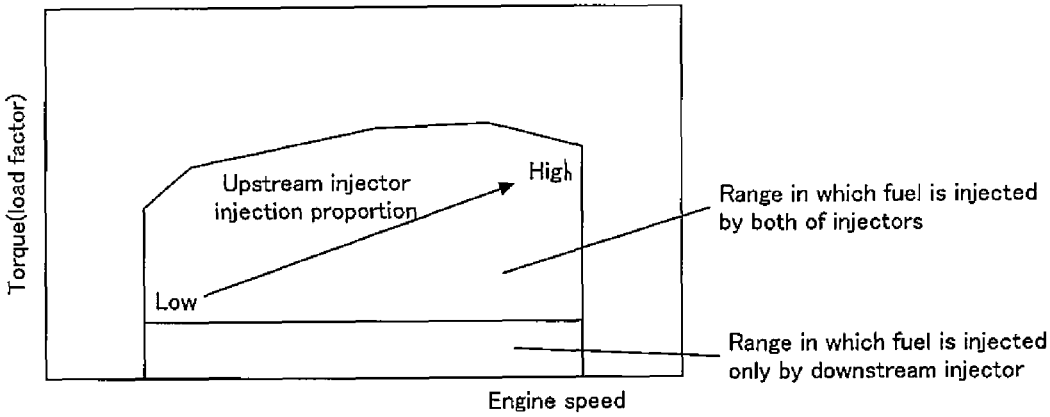
FIG. 2 is a view in which actions of respective injectors performed by the fuel injection control device of embodiment 1 of the present invention are shown in connection with operating ranges of the internal combustion engine

FIG. 2 is a view in which the actions of the respective injectors 10 and 12 are shown in connection with operating ranges of the internal combustion engine that are defined by the engine speed and the torque (or load factor). As shown in FIG. 2, in the control of the injectors 10 and 12 by the present fuel injection control device, the operating range of the internal combustion engine is divided into two ranges. Specifically, the operating range of the internal combustion is divided into a low torque range and a middle-high torque range. As described below, the present fuel injection control device controls the actions of the respective injectors 10 and 12 according to modes that are set for each range.

The low torque range is taken as a range in which a requested injection quantity is less than the sum of the lower limit injection quantities of the injectors 10 and 12. The requested injection quantity is a fuel injection quantity per cycle that is necessary to attain the requested torque, and is mainly calculated using an intake air quantity and a target air-fuel ratio. The lower limit injection quantity is the minimum fuel injection quantity that the injector is capable of injecting, and is determined by the specifications of the injector. The lower limit injection quantity is defined for each of the injectors 10 and 12. In the low torque range, the two injectors 10 and 12 can not be actuated together because the requested injection quantity is small. Therefore, when the internal combustion engine is operating in the low torque range, the present fuel injection control device stops the first injector 10 on the upstream side and actuates only the second injector 12 that is disposed under a thermally severe condition. It is thereby possible to cool the tip of the second injector 12 with fuel, and thereby suppress the adherence of deposits to the second injector 12.

The middle-high torque range is taken as a range in which a requested injection quantity is equal to or greater than the sum of the lower limit injection quantities of the injectors 10 and 12. When the internal combustion engine is operating in the middle-high torque range, the present fuel injection control device actuates both of the injectors 10 and 12. That is, the present fuel injection control device causes the first injector 10 on the upstream side and the second injector 12 on the downstream side to inject fuel. However, the proportions of fuel injected by the respective injectors 10 and 12 are not equal. The present fuel injection control device makes a proportion of fuel injected by the second injector 12 larger than a proportion of fuel injected by the first injector 10. By deciding the injection proportions of the respective injectors 10 and 12 in this manner, a cooling effect produced by fuel at the second injector 12 that is at a thermally severe position can be increased. In addition, by also injecting fuel from the first injector 10, and not just from the second injector 12, it is possible to cool the first injector 10 by fuel, and at the same time, further cool the second injector 12 that is downstream thereof by means of latent heat of vaporization when the fuel injected by the first injector 10 vaporizes.

Furthermore, the present fuel injection control device increases the proportion of fuel injected by the first injector 10 as the intake air quantity increases, while maintaining the proportion of fuel injected by the second injector 12 as a larger proportion as described above. That is, the larger that the intake air quantity becomes, the closer that the proportions of fuel injected by the respective injectors 10 and 12 come to being equal. As the intake air quantity increases, an effect by the air carrying away heat increases, and at the same time, the cooling effect that is produced by the fuel also increases in accordance with an increase in the fuel injection quantity. Therefore, the margin for lowering the proportion of fuel injected by the second injector 12 increases in accordance with an increase in the intake air quantity. On the other hand, with respect to the fuel injection by the first injector 10, since a certain time period exists between the time that the fuel is injected and the time that the injected fuel enters the cylinder, it is easier for atomization of the fuel to proceed in comparison to fuel injection by the second injector 12. Consequently, by increasing the proportion of fuel injected by the first injector 10 in accordance with the intake air quantity, it is possible to promote atomization of the fuel and improve the homogeneity of the air-fuel mixture while suppressing the adherence of deposits to the second injector 12.

Figure 3:
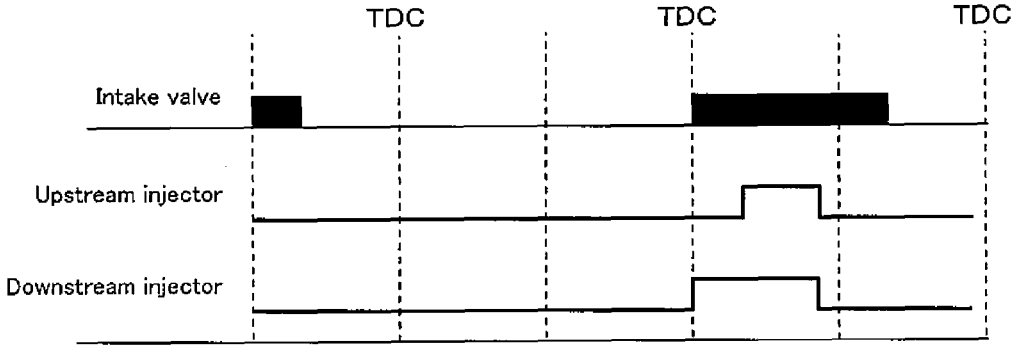
FIG. 3 is a timing chart that illustrates fuel injection periods of the respective injectors by the fuel injection control device of embodiment 1 of the present invention.

FIG. 3 is a timing chart that illustrates fuel injection periods of the respective injectors 10 and 12 in a case where both of the injectors 10 and 12 are actuated. In this timing chart, periods in which the intake valve is open are shown in conjunction with the fuel injection periods of the respective injectors 10 and 12. In general, fuel injection performed in a period in which the intake valve is open is referred to as "synchronous injection", and fuel injection performed in a period in which the intake valve is closed is referred to as "asynchronous injection". As shown in FIG. 2, the present fuel injection control device causes each of the injectors 10 and 12 to perform fuel injection by synchronous injection. When the two injectors 10 and 12 operate together, because the proportion of fuel injected by the second injector 12 is made larger than the proportion of fuel injected by the first injector 10, the fuel injection period of the second injector 12 is longer than that of the first injector 10. In this case, the fuel injection end timings are made the same for the two injectors 10 and 12, and the fuel injection periods of the respective injectors 10 and 12 are adjusted by varying the fuel injection start timings. By performing synchronous injection by means of the respective injectors 10 and 12, air that is taken into the cylinder is cooled by latent heat of vaporization when fuel vaporizes, and thus the in-cylinder temperature can be lowered. If the in-cylinder temperature falls, not only can knocking be reduced, but an improvement in fuel consumption and an improvement in transient torque characteristics can also be achieved as the result of an improvement in the air charging efficiency. Further, since fuel injected from the first injector 10 rides on the intake air flow and vaporizes in the vicinity of the second injector 12 that is downstream thereof, it is possible to obtain a greater cooling effect on the second injector 12 by means of latent heat of vaporization.

Embodiment 2

Embodiment 2 of the present invention will now be described with reference to the drawings.

Similarly to Embodiment 1, a fuel injection control device according to the present embodiment is applied to an internal combustion engine that is configured as shown in FIG. 1.

Figure 4:
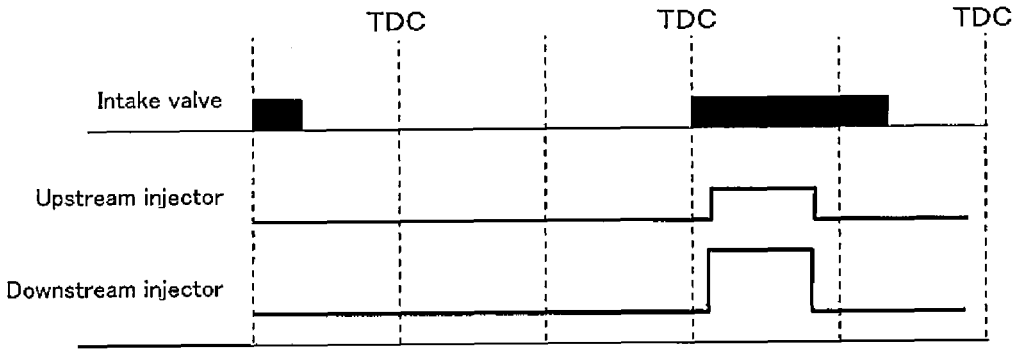
FIG. 4 is a timing chart that illustrates fuel injection periods of respective injectors by a fuel injection control device of embodiment 2 of the present invention.

However, according to the present embodiment, the flow rate of the second injector 12 on the downstream side is made greater than the flow rate of the first injector 10 on the upstream side. A timing chart that illustrates injection periods of the respective injectors 10 and 12 when both of the injectors 10 and 12 are actuated in this case is shown in FIG. 4. As shown in the timing chart, the fuel injection period required by the second injector 12 can be shortened by increasing the flow rate of the second injector 12. Consequently, the fuel injection periods at the two injectors 10 and 12 can be made approximately the same, and it is possible to unify the control between the two injectors 10 and 12.

Note that, in the present embodiment also, the injection proportions of the respective injectors 10 and 12 are determined in accordance with the operating range of the internal combustion engine and the intake air quantity, and the injection timings of the respective injectors 10 and 12 are determined so as to perform synchronous injection. The configuration of the present embodiment is common with that of Embodiment 1 with respect to these points.

Embodiment 3

Embodiment 3 of the present invention will now be described with reference to the drawings.

Figure 5:
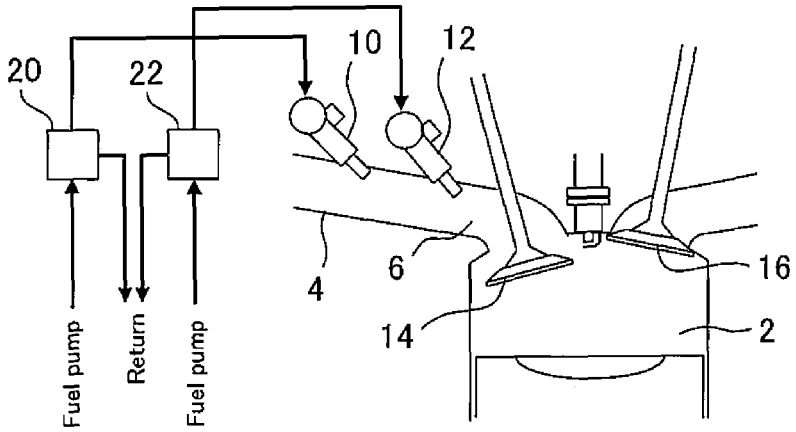
FIG. 5 is a view that illustrates a configuration of a fuel supply system of an internal combustion engine to which a fuel injection control device of embodiment 3 of the present invention is applied.

Similarly to Embodiment 1, a fuel injection control device according to the present embodiment is applied to an internal combustion engine that is configured as shown in FIG. 1. However, a feature of the internal combustion engine to which the present fuel injection control device is applied is the configuration of a fuel supply system thereof. In the present embodiment, the fuel supply system of the internal combustion engine is configured as shown in FIG. 5. FIG. 5 illustrates a state in which an intake valve 14 is open and an exhaust valve 16 is closed, that is, the state of the internal combustion engine at the time of an intake stroke. In FIG. 5, components or sites that are the same as components or sites shown in FIG. 1 are denoted by the same reference numerals as in FIG. 1.

As shown in FIG. 5, the internal combustion engine to which the present fuel injection control device is applied includes a fuel supply system that supplies fuel to the first injector 10 and a fuel supply system that supplies fuel to the second injector 12, respectively. In the former fuel supply system, a low pressure regulator 20 is provided that regulates the pressure of fuel that is supplied to the first injector 10 so as to be a predetermined low-pressure value. In the latter fuel supply system, a high pressure regulator 22 is provided that regulates the pressure of fuel that is supplied to the second injector 12 so as to be a predetermined high-pressure value. According to this configuration, since an injection quantity per unit time injected by the second injector 12 can be made larger than an injection quantity per unit time injected by the first injector 10, similarly to the case in Embodiment 2, it is possible for the fuel injection periods at the two injectors 10 and 12 to be made approximately the same. In addition, according to the present embodiment, it is also possible to atomize the fuel that is injected by the second injector 12.

Note that, in the present embodiment also, the injection proportions of the respective injectors 10 and 12 are determined in accordance with the operating range of the internal combustion engine and the intake air quantity, and the injection timings of the respective injectors 10 and 12 are determined so as to perform synchronous injection. The configuration of the present embodiment is common with that of Embodiment 1 and Embodiment 2 with respect to these points.

Embodiment 4

Embodiment 4 of the present invention will now be described with reference to the drawings.

Similarly to Embodiment 1, a fuel injection control device according to the present embodiment is applied to an internal combustion engine that is configured as shown in FIG. 1. The present embodiment differs from Embodiment 1 with respect to the method for determining a fuel injection quantity that is determined for each of the injectors 10 and 12. The present fuel injection control device determines the fuel injection quantities of the respective injectors 10 and 12 according to a procedure shown in a flowchart illustrated in FIG. 6.

Figure 6:
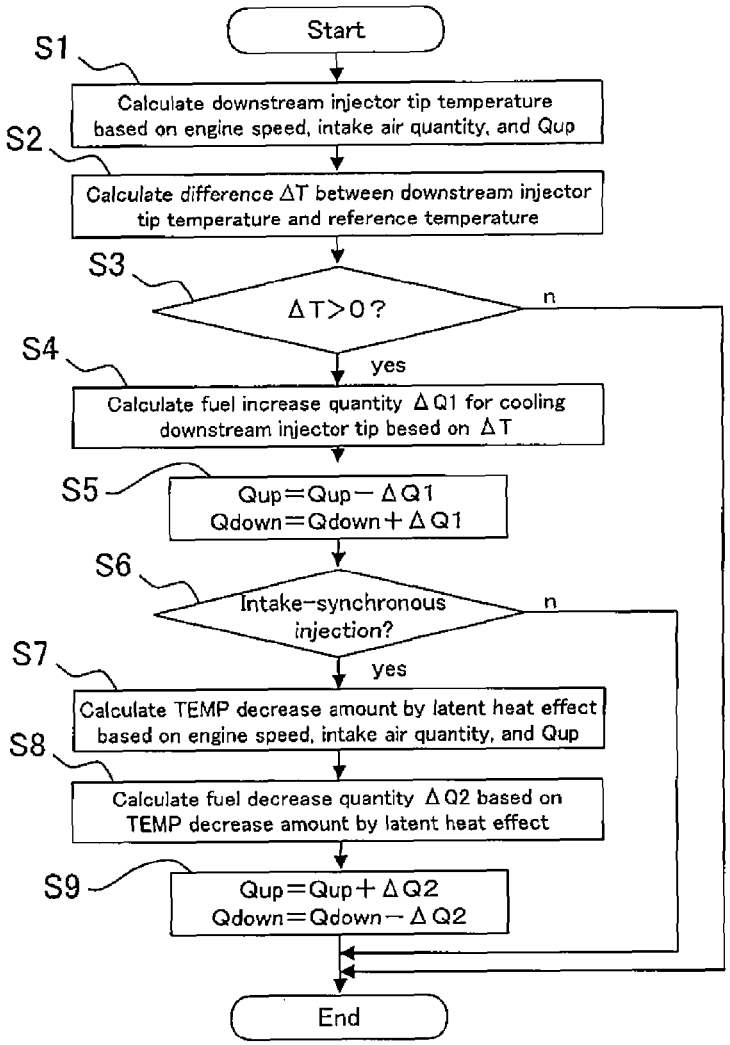
FIG. 6 is a flow chart that shows a procedure for determining fuel injection quantities of respective injectors by a fuel injection control device of embodiment 4 of the present invention.

According to the flowchart illustrated in FIG. 6, in an initial step S1, a temperature of the tip of the second injector 12 is calculated based on the engine speed, the torque (or load factor), and the intake air temperature. A calculation formula derived from a model, or a calculation formula or map based on experiments can be used for this calculation. Subsequently, in the next step, a difference $\Delta T$ between the injector tip temperature calculated in step S1 and a reference temperature is calculated. The reference temperature is a temperature that serves as a reference for determining whether it is necessary to cool the tip of the second injector 12. The reference temperature may be a fixed value, or may be changed in accordance with, for example, an engine speed, a torque (or a load factor), an intake air temperature, or a combination of the aforementioned values.

In step S3, it is determined whether or not the difference $\Delta T$ between the injector tip temperature and the reference temperature that is calculated in step S2 is greater than 0. If the difference $\Delta T$ is less than or equal to zero, that is, if the injector tip temperature is less than or equal to the reference temperature, a basic injection quantity of the respective injectors 10 and 12 that is currently determined is maintained as it is. The basic injection quantity is a fuel injection quantity of the respective injectors 10 and 12 that is determined based on the premise that intake-asynchronous injection will be performed.

In contrast, if the difference $\Delta T$ is greater than zero, the processing in steps S4 and S5 is performed. In step S4, a fuel increase quantity $\Delta Q1$ that is required to cool the tip of the second injector 12 is calculated based on the difference $\Delta T$. A calculation formula derived from a model, or a calculation formula or map based on experiments can be used for this calculation. Next, in step S5, a value obtained by subtracting the fuel increase quantity $\Delta Q1$ from a fuel injection quantity Qup of the first injector 10 in the case of performing intake-asynchronous injection is determined as the new fuel injection quantity Qup of the first injector 10, and a value obtained by adding the fuel increase quantity $\Delta Q1$ to a fuel injection quantity Qdown of the second injector 12 in the case of performing intake-asynchronous injection is determined as the new fuel injection quantity Qdown of the second injector 12.

Next, in step S6, it is determined whether or not to perform intake-synchronous injection based on the operating state of the internal combustion engine or the environmental conditions. If intake-synchronous injection is not to be performed, the fuel injection quantities of the respective injectors 10 and 12 calculated in step S5 are maintained as they are.

If intake-synchronous injection is to be performed, the processing in steps S7, S8, and S9 is executed. In step S7, a temperature decrease amount that corresponds to an effect by latent heat of vaporization is calculated based on the engine speed, the intake air quantity, and the fuel injection quantity of the first injector 10. The term "temperature decrease amount that corresponds to an effect by latent heat of vaporization" refers to a temperature decrease amount of the second injector 12 that is obtained by means of latent heat of vaporization of fuel that was injected by the first injector 10 in a case where fuel injection by the first injector 10 is intake-synchronous injection. Next, in step S8, a fuel decrease quantity ΔQ2 that corresponds to an effect by latent heat of vaporization is calculated based on the temperature decrease amount that corresponds to an effect by latent heat of vaporization. A calculation formula derived from a model, or a calculation formula or map based on experiments can be used for these calculations. Next, in step S9, a value obtained by adding the fuel decrease quantity ΔQ2 to the fuel injection quantity Qup of the first injector 10 calculated in step S5 is determined as the new fuel injection quantity Qup of the first injector 10, and a value obtained by subtracting the fuel decrease quantity ΔQ2 from the fuel injection quantity Qdown of the second injector 12 in the case of performing intake-asynchronous injection is determined as the new fuel injection quantity Qdown of the second injector 12.

As described above, when performing fuel injection by synchronous injection at the two injectors 10 and 12, the present fuel injection control device decreases the proportion of fuel that is injected by the second injector 12 in comparison to the case of injecting fuel of the same quantity from the respective injectors 10 and 12 by asynchronous injection. This is because, according to synchronous injection, the fuel quantity injected from the second injector 12 can be reduced by an amount that corresponds to an increase in a cooling effect on the second injector 12 that is obtained by means of latent heat of vaporization. According to the present fuel injection control device, since the proportion of fuel injected by the first injector 10 is increased by the above described amount, atomization of fuel can be promoted further to further improve the homogeneity of the air-fuel mixture.

Note that the fuel injection quantity control according to the present embodiment can be applied to the internal combustion engine of Embodiment 2 and Embodiment 3 also, and not only to the internal combustion engine of Embodiment 1.

Embodiment 5

Embodiment 5 of the present invention will now be described with reference to the drawings.

Figure 7:
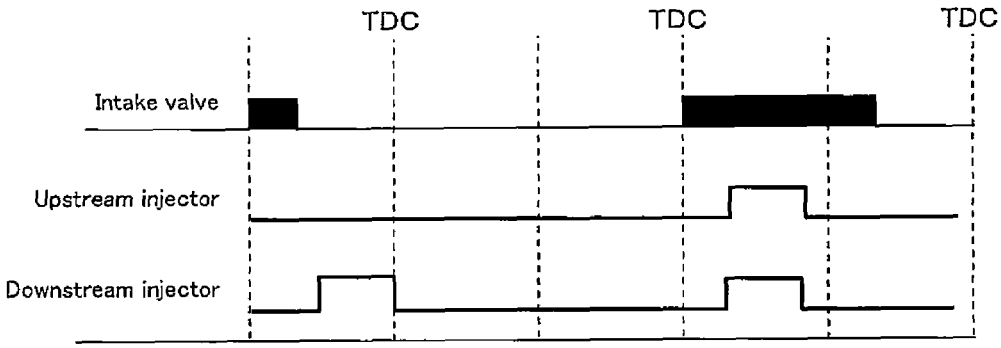
FIG. 7 is a timing chart that illustrates fuel injection periods of respective injectors by a fuel injection control device of embodiment 5 of the present invention.

Similarly to Embodiment 1, a fuel injection control device according to the present embodiment is applied to an internal combustion engine that is configured as shown in FIG. 1. The present embodiment differs from Embodiment 1 with respect to the setting of injection periods of the injectors 10 and 12 when actuating both of the injectors 10 and 12. More specifically, in the present embodiment, the injection period of the second injector 12 on the downstream side is set differently to Embodiment 1. FIG. 7 is a timing chart that shows the injection periods of the respective injectors 10 and 12 when actuating both of the injectors 10 and 12 according to the present embodiment. This timing chart is described below.

As shown in FIG. 7, with respect to the second injector 12, the present fuel injection control device causes the second injector 12 to inject fuel by dividing the fuel injection operation into an asynchronous injection operation and a synchronous injection operation. That is, the second injector 12 is caused to inject some fuel by asynchronous injection prior to synchronous injection. In contrast, the first injector 10 is caused to inject all of the fuel by synchronous injection. In a state in which the intake valve is closed, EGR gas containing NOx that serves as a base for formation of deposits stays in the vicinity of the tip of the second injector 12 for an extended period. Consequently, deposits are liable to be formed on the tip of the second injector 12 by means of radiant heat from the combustion chamber 2. However, by dividing the fuel injection into two operations and injecting some of the fuel of the second injector 12 by asynchronous injection as in the present embodiment, initial deposits can be blown off from the tip of the second injector 12. That is, it is possible to suppress adherence of deposits to the second injector 12 more effectively.

Note that the fuel injection quantity control according to the present embodiment can be applied to the internal combustion engine of Embodiment 2 and Embodiment 3 also, and not only to the internal combustion engine of Embodiment 1. The fuel injection quantity control according to the present embodiment can also be combined with the fuel injection quantity control of Embodiment 4.

Others

The present invention is not limited to the above described embodiments, and various modifications can be made without departing from the spirit and scope of the present invention. For example, when actuating the two injectors 10 and 12, it is also possible to make the proportions of fuel injected by the respective injectors 10 and 12 constant regardless of the magnitude of the intake air quantity. In addition, it is also possible to cause at least one of the injectors 10 and 12 to perform fuel injection by asynchronous injection.

Figure 8:
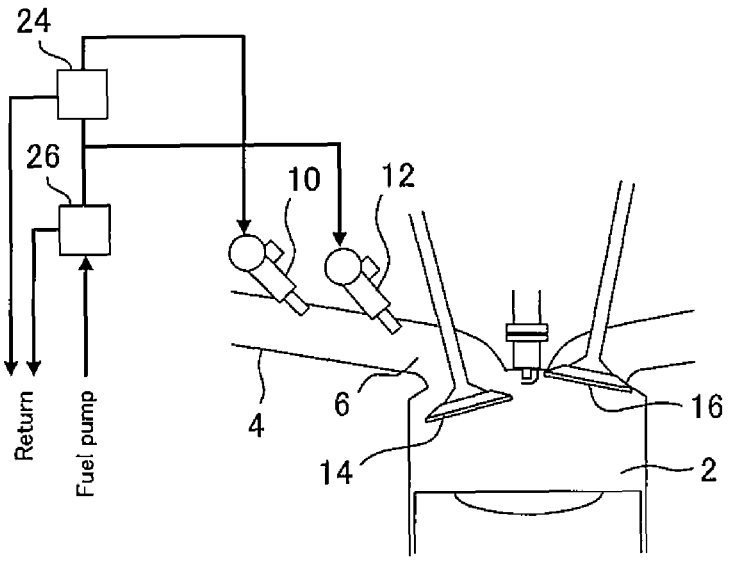
FIG. 8 is a view that illustrates another configuration of a fuel supply system of an internal combustion engine to which a fuel injection control device of the present invention is applied.

In Embodiment 3, it is also possible to use the configuration of a fuel supply system that is shown in FIG. 8 instead of the configuration of the fuel supply system shown in FIG. 5. The fuel supply system shown in FIG. 8 is a fuel supply system that is shared by the two injectors 10 and 12. A high pressure regulator 26 and a low pressure regulator 24 are arranged in series in a fuel supply line of this fuel supply system. High-pressure fuel that has been subjected to pressure regulation by the high pressure regulator 26 is supplied to the second injector 12, and low-pressure fuel that has been subjected to pressure regulation by the low pressure regulator 24 is supplied to the first injector 10. Thus, similarly to the case described in Embodiment 3, an injection quantity per unit time that is injected by the second injector 12 can be made larger than an injection quantity per unit time that is injected by the first injector 10.

Figure 9:
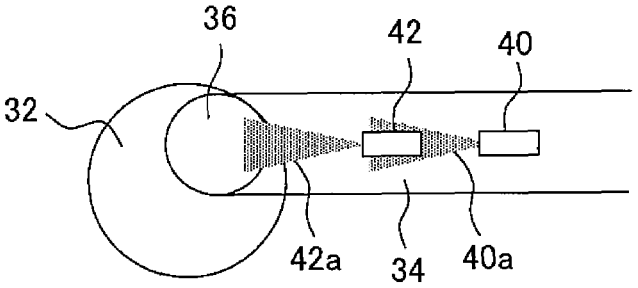
FIG. 9 is a view that illustrates another configuration in an area around an intake port of an internal combustion engine to which a fuel injection control device of the present invention is applied.

The present invention can also be applied to an internal combustion engine having a configuration shown in FIG. 9. The internal combustion engine shown in FIG. 9 is a single-port type internal combustion engine in which only one intake port 36 is connected to a combustion chamber 32. Two injectors 40 and 42 are disposed in an aligned relationship in the flow direction of the intake pipe 34 on the upstream side of the intake port 36. The first injector 40 that is on the upstream side can inject fuel in a single direction, and a single fuel spray 40*a* is formed by fuel injected therefrom. Likewise, the second injector 42 can inject fuel in a single direction, and a single fuel spray 42*a* is formed by fuel injected therefrom. The present invention can be configured as a fuel injection control device that controls the actions of these two injectors 40 and 42.

DESCRIPTION OF REFERENCE NUMERALS

2 Combustion chamber
4 Intake pipe
6, 8 Intake port

10 First injector
10*a* Fuel spray by first injector
12 Second injector
12*a*, 12*b* Fuel spray by second injector

The invention claimed is:

1. A fuel injection control device for an internal combustion engine comprising a first injector that is disposed at an upstream position in an intake pipe and a second injector that is disposed at a downstream position in the intake pipe, wherein when a requested fuel injection quantity is equal to or greater than a reference value that is set to a value that is equal to or greater than a sum of lower limit injection quantities of the respective injectors, both of the injectors are actuated together while making a proportion of fuel that is injected by the second injector larger than a proportion of fuel that is injected by the first injector and increasing the proportion of fuel that is injected by the first injector in accordance with an increase in an intake air quantity.

2. The fuel injection control device for an internal combustion engine according to claim 1, wherein, when actuating both of the injectors together, the fuel injection control device causes both of the injectors to perform fuel injection by synchronous injection.

3. The fuel injection control device for an internal combustion engine according to claim 2, wherein, when causing both of the injectors to perform fuel injection by synchronous injection, the fuel injection control device reduces the proportion of fuel that is injected by the second injector in comparison to a case of injecting fuel of identical quantities by asynchronous injection.

4. The fuel injection control device for an internal combustion engine according to claim 2, wherein, when causing both of the injectors to perform fuel injection by synchronous injection, the fuel injection control device causes the second injector to inject some fuel by asynchronous injection prior to the synchronous injection.

5. The fuel injection control device for an internal combustion engine according to claim 1, wherein a flow rate of the second injector is greater than a flow rate of the first injector.

6. The fuel injection control device for an internal combustion engine according to claim 1, wherein a pressure of fuel that is supplied to the second injector is higher than a pressure of fuel that is supplied to the first injector.

7. The fuel injection control device for an internal combustion engine according to claim 1, wherein, when a requested fuel injection quantity is less than the reference value, the fuel injection control device actuates only the second injector.

* * * * *